United States Patent [19]

Van Daalen et al.

[11] Patent Number: 4,951,495

[45] Date of Patent: Aug. 28, 1990

[54] MACHINE TOOL WITH C-SHAPED FRAME

[75] Inventors: Peter Van Daalen, Hengelo; Antonius H. Groot Zwaaftink, Borne, both of Netherlands

[73] Assignee: Holding M. Brouwer & Co. B.V., Hengelo, Netherlands

[21] Appl. No.: 376,018

[22] Filed: Jul. 6, 1989

[30] Foreign Application Priority Data

Jul. 14, 1988 [NL] Netherlands ..... 8801799

[51] Int. Cl.[5] ..... B30B 1/18

[52] U.S. Cl. ..... 72/455; 100/231; 83/859

[58] Field of Search ..... 72/455, 456; 83/613, 83/859; 100/231

[56] References Cited

U.S. PATENT DOCUMENTS

| | | | |
|---|---|---|---|
| 2,916,987 | 12/1959 | Hanni | 100/231 |
| 3,991,602 | 11/1976 | Harcuba et al. | 100/231 |
| 4,321,819 | 3/1982 | Kraft et al. | 72/456 |

FOREIGN PATENT DOCUMENTS

| | | | |
|---|---|---|---|
| 1920749 | 11/1969 | Fed. Rep. of Germany | 100/231 |
| 2234224 | 1/1974 | Fed. Rep. of Germany | 100/231 |
| 3137799 | 4/1983 | Fed. Rep. of Germany | 100/231 |
| 20479 | 2/1977 | Japan | 100/231 |
| 8603305 | 7/1988 | Netherlands . | |
| 1063629 | 12/1983 | U.S.S.R. | 100/231 |

*Primary Examiner*—David Jones

*Attorney, Agent, or Firm*—Edmund M. Jaskiewicz

[57] ABSTRACT

A machine tool, in particular a machine for working with punches and dies parts formed from sheet material, comprises an essentially C-shaped frame made up of two parallel-connected, essentially C-shaped frame parts. The first frame part is designed to absorb the reaction forces from forces exerted by tools placed between the arms of the C-shaped parts. The second frame part is designed to hold the tools in a desired position relative to each other. The two C-shaped frame parts near the ends of the arms thereof are connected to each other only by means of a hinge joint between the bottom arm of the first C-shaped frame part and the neighboring bottom arm of the second C-shaped frame part, and a connecting element which at one side is hingedly connected to the top arm of the first C-shaped frame part by means of a hinge joint and at the other side is connected to the top arm of the second C-shaped frame part. The frame parts are connected in such a way that said connecting element can be moved in the working direction of the tools. The axes of the hinge joints are essentially at right angles to the principal plane of the C-shaped frame part, and intersect the common axis of tools placed between the arms of the C-shaped frame parts.

5 Claims, 5 Drawing Sheets

MACHINE TOOL WITH C-SHAPED FRAME

BACKGROUND OF THE INVENTION

The invention relates to a machine tool, in particular a machine for working with punches and dies parts formed from sheet material, comprising an essentially C-shaped frame made up of two parallel-connected, essentially C-shaped parts, the first of which is designed to absorb the reaction forces from forces exerted by tools placed between the arms of the C-shaped parts, while the second is designed to hold the tools in a desired position relative to each other.

Such a machine is known from German Offenlegungsschrift No. 19 20 749. Such machines are used for, for example, punching holes of varying sizes in material of sometimes considerable thickness. The forces exerted on the frame can be very great; often of the order of many thousands of newtons.

A problem which occurs in machine tools with C-shaped frames is that, due to the considerable forces which are exerted on the C-shaped frame, the frame tends to gape, i.e. the arms of the frame bend apart during the machining of a workpiece. The position of the tools in the bottom and top arm relative to each other cannot consequently be fully controlled. This leads to a loss of accuracy. In punching machines in particular this is undesirable. In punching machines the degree of gaping of the frame is one of the factors affecting the size of the clearance between punch and die. The greater the "gaping effect" the more the clearance deviates from the clearance corresponding to a particular sheet thickness, and the greater is the burr information.

An attempt to eliminate these disadvantages of conventional C-shaped frames was made by providing a C-shaped frame made up of two parts, one part absorbing the reaction forces exerted by the tools, and the other part having to hold the tool (for example, punch and die) as well as possible in their correct positions.

In old frames of this type the two frame parts were connected to each other, either by means of the bedplate (which in that case has to be made very heavy), or by means of the table of the machine. In these machines, however, the frame parts could not function independently of each other, so appreciable gaping took place.

An improvement was made over the German Offenlegungsschrift, in which the two C-shaped frame parts are connected by a press table, by connecting the two parts of the frame hingedly to each other of the machine couples were produced which tended to make both frame parts gape, so that the accuracy was not always optimum, particularly if very considerable forces were exerted.

SUMMARY OF THE INVENTION

The object of the invention is to provide a machine tool of the type mentioned in the preamble, in which even during the exertion of very considerable forces the tools are held in a predetermined position relative to each other, so that the dimensions of the parts of the tools mating with each other can be adjusted more accurately to each other. The invention also aims at completely eliminating couples which can occur in known machine tools of the abovementioned type.

This object is achieved according to the invention by a machine tool of the abovementioned type which is characterized in that the two C-shaped parts of the frame near the ends of the arms thereof are connected to each other only by means of a hinge joint between a bottom arm of the first C-shaped frame part and a neighboring bottom arm of the second C-shaped frame part, and by means of a connecting element which at one side is hingedly connected to the top arm of the first C-shaped frame part and at the other side is connected to the top arm of the second C-shaped frame part, in such a way that said connecting element can be moved in the working direction of the tools, and the axes of the hinge joints are essentially at right angles to the principal plane of the C-shaped frame parts and intersect the common axis of tools placed between the arms of the C-shaped parts.

The envisaged objective is achieved with such a frame. The frame as a whole cannot gape, because the second part does not absorb any reaction forces from the forces exerted by the tools, and therefore the arms of this second part are not driven apart. The first part of the frame can move in such a way, due to its independent set-up, that the forces exerted do not affect the alignment of the tools relative to each other. The positioning of the axes of the hinges at right angles to the principal plane of the C-shaped parts while the axes intersect the common axis of tools placed between the arms of the C-shaped parts completely prevents the occurrence of couples which could lead to gaping.

Advantageous embodiments of the invention are laid down in the sub-claims.

The invention will be explained in greater detail below by the description of an example of an embodiment with reference to the appended drawings.

DETAILED DESCRIPTION OF A PREFERRED EMBODIMENT

Figure 1:
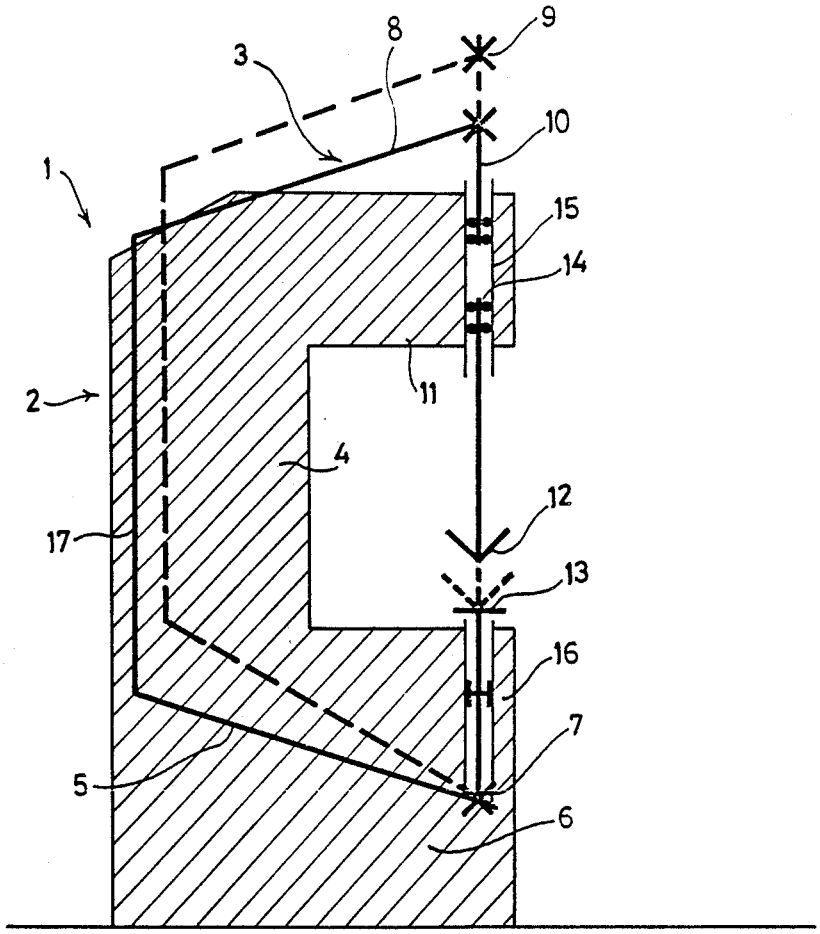
FIG. 1 shows a schematic illustration of the device according to the invention, with reference to which the principle of the invention is explained.
Figure 2:
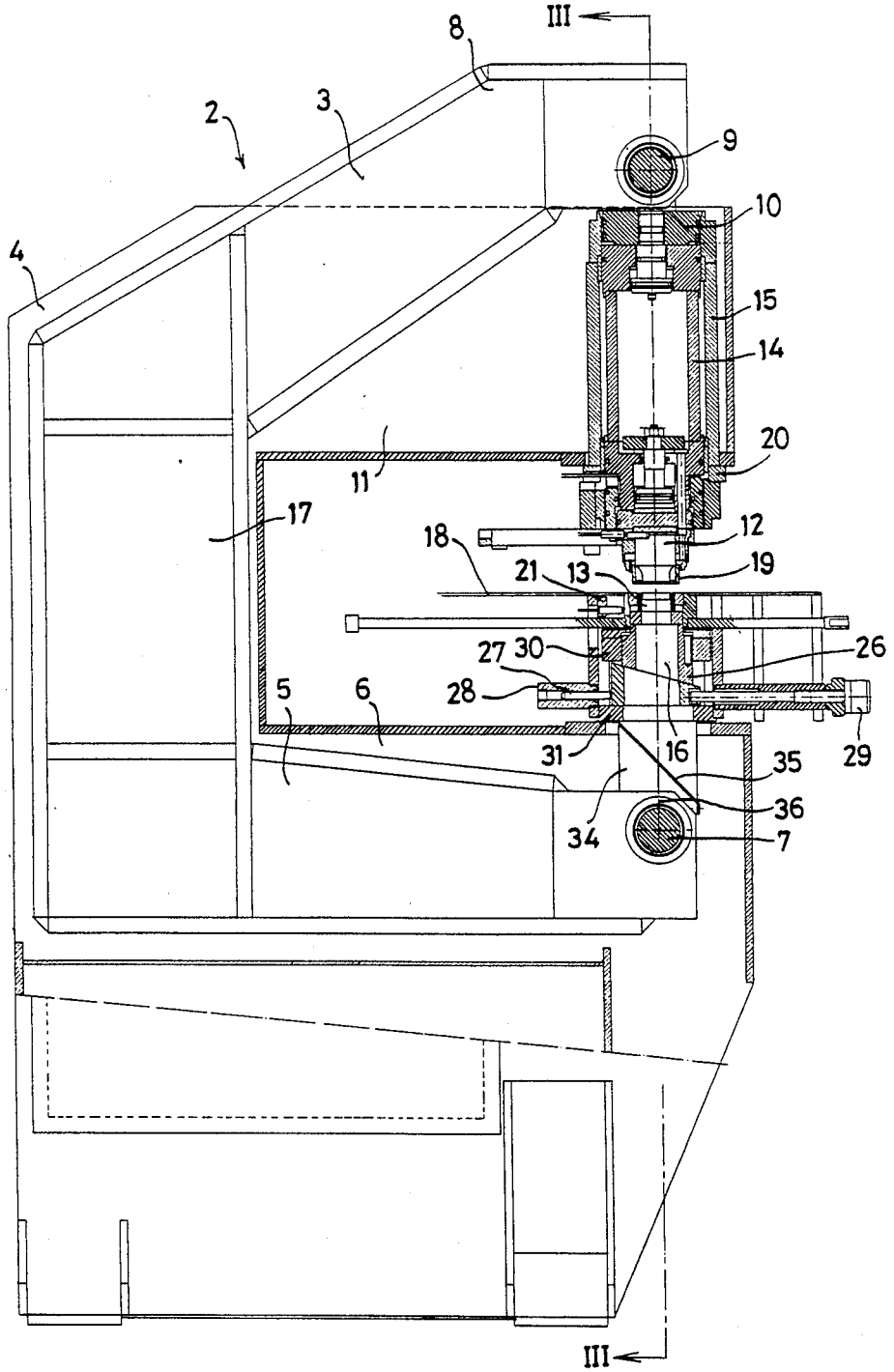
FIG. 2 shows an embodiment of the device according to the invention in vertical section.
Figure 3:
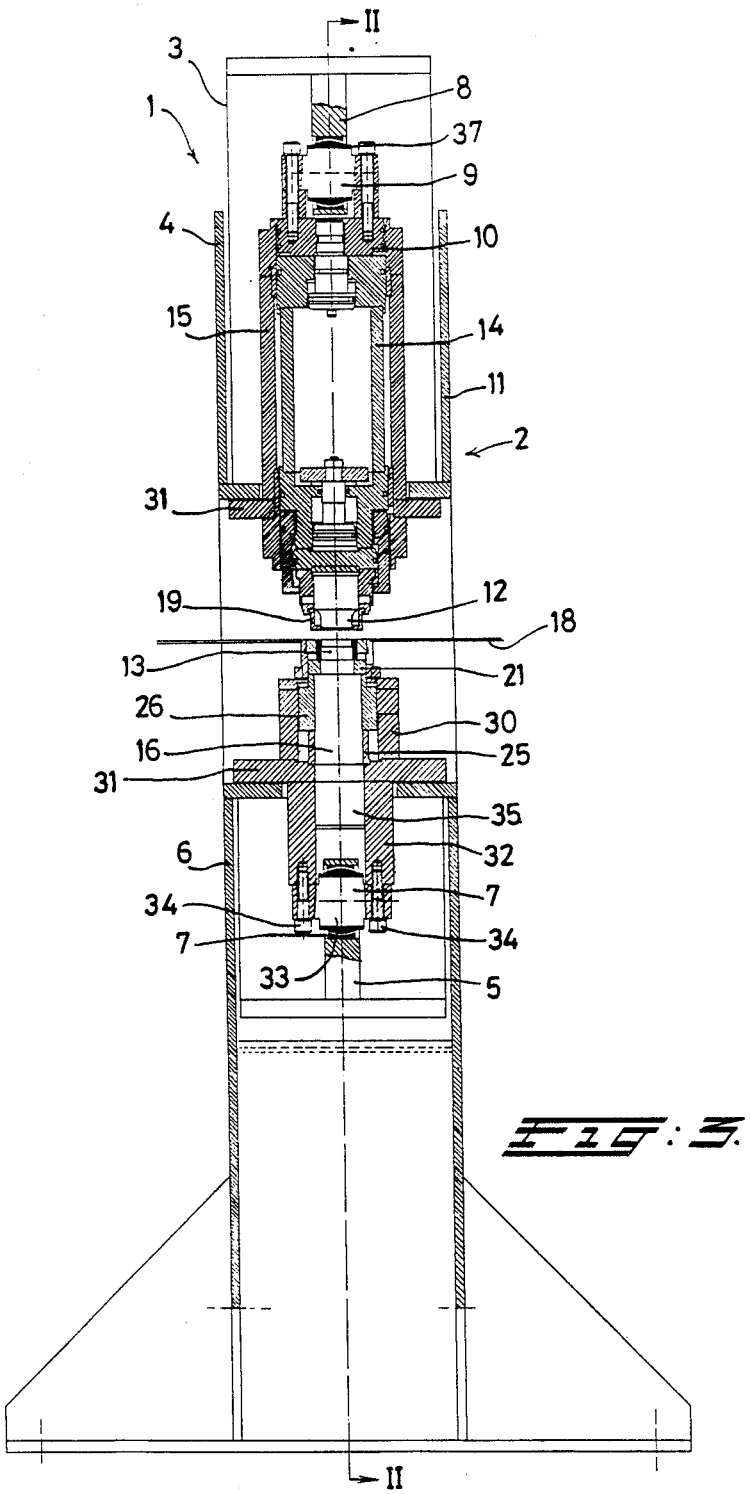
FIG. 3 shows a view of the device of FIG. 2, in a cross section, along the line III—III in FIG. 2.

FIG. 1 shows a machine tool 1, for example a punching machine. This machine has an essentially C-shaped frame 2, comprising two parallel-linked, essentially C-shaped parts 3 and 4. The first part 3 is designed to absorb the punching and reaction forces of forces exerted by punching tools placed between the arms of the two frame parts, while the second part 4 is designed to hold the punching tools (not shown in any further detail in this figure) in their correct position relative to each other, as is known per se.

The first frame part 3 is in the form of a body with a flange. The second frame part 4 is a box structure lying round the first frame part 3.

The two frame parts can move independently of each other. They are only hingedly connected to each other. At the bottom side the bottom arm 5 of the first frame part is hingedly connected to the bottom arm 6 of the second frame part by means of a bottom hinge joint 7. At the top side the top arm 8 of the first frame part is connected by means of a top hinge joint 9 to a connecting element 10. This connecting element 10 is connected to the top arm 11 of the second frame part so that it is movable in the working direction of the tools in a way to be described in greater detail. The tools, which are not shown in any further detail, can be a punch 12 and a die 13. The punch 12 is driven by a piston 14 which is hydraulically movable in a cylinder 15. The die 13 is essentially immobile; it is connected to the bottom hinge joint 7 by means of an assembly 16 of parts which will be described further below.

It can be seen clearly that the common axis of the tools 12, 13 and the bottom and top hinge points 7, 9 are in line with each other.

If a punching force is now exerted by the piston/cylinder device 14, 15 on the punch 12, the latter comes into contact with the die 13 via a workpiece (not further shown) placed thereon. A reaction force which is equal to the force exerted by the piston/cylinder device 14, 15 is produced. These two forces are transmitted to the hinge points 7, 9. Through the action of these forces the frame 3 will gape, as is known. The arms 5, 8 of the first frame part 3 will be moved apart, while the back part 17 of the first frame part will be moved inwards, all this as shown by dashed lines in FIG. 1.

The punch 12 is guided in a straight line in the cylinder 15, which is fixed on the top arm 11 of the second frame part 4. The die 13 is held straight through the fact that the assembly 16 of parts is guided in the bottom arm 6 of the second frame part. The second frame part 4 absorbs neither the force exerted by the piston/cylinder device 14, 15 nor the reaction force.

Due to the fact that the hinge pints 7, 9 are aligned with the common axis of the tools 12, 13, no couple tending to move the arms 6, 11 of the second frame part apart occurs. The alignment of the tools 12, 13 relative to each other is thus fully retained. It is, however, pointed out that this effect requires the axes of the hinge joints 7, 9 to be at right angles to the principal plane of the first frame part 3.

The other figures show an embodiment of the invention. The same reference numbers are used for parts shown in the other figures which correspond to parts shown in FIG. 1.

The machine tool to be described is a punching machine with a hydraulic drive 14, 15. The first C-shaped frame part 3, lying inside the second C-shaped frame part 4, can be seen clearly. The bottom arms 5, 6 of the first and second frame parts respectively are attached to each other by means of a hinge joint 7. The top arm 8 of the first frame part 3 is hingedly attached at 9 to a cover 10 (which will be described below), which serves as a connecting element for connecting the top arm 8 of the frame part 3 to the top arm 11 of the second frame part 4 by means of the cylinder 15. A punch 12 and a die 13 are mounted in the machine in a known manner. A table 18 is present, which is intended only to bear the weight of the workpiece during the machining, and does not absorb any other forces. A known stripper 19 which prevents the workpiece from remaining hanging from the die is also provided. The hydraulic drive is known per se, and is not described in any further detail. A cylinder positioning plate 20 is used for accurate positioning of the cylinder 15, and thus of the punch 12 relative to the die 13.

Figure 4:
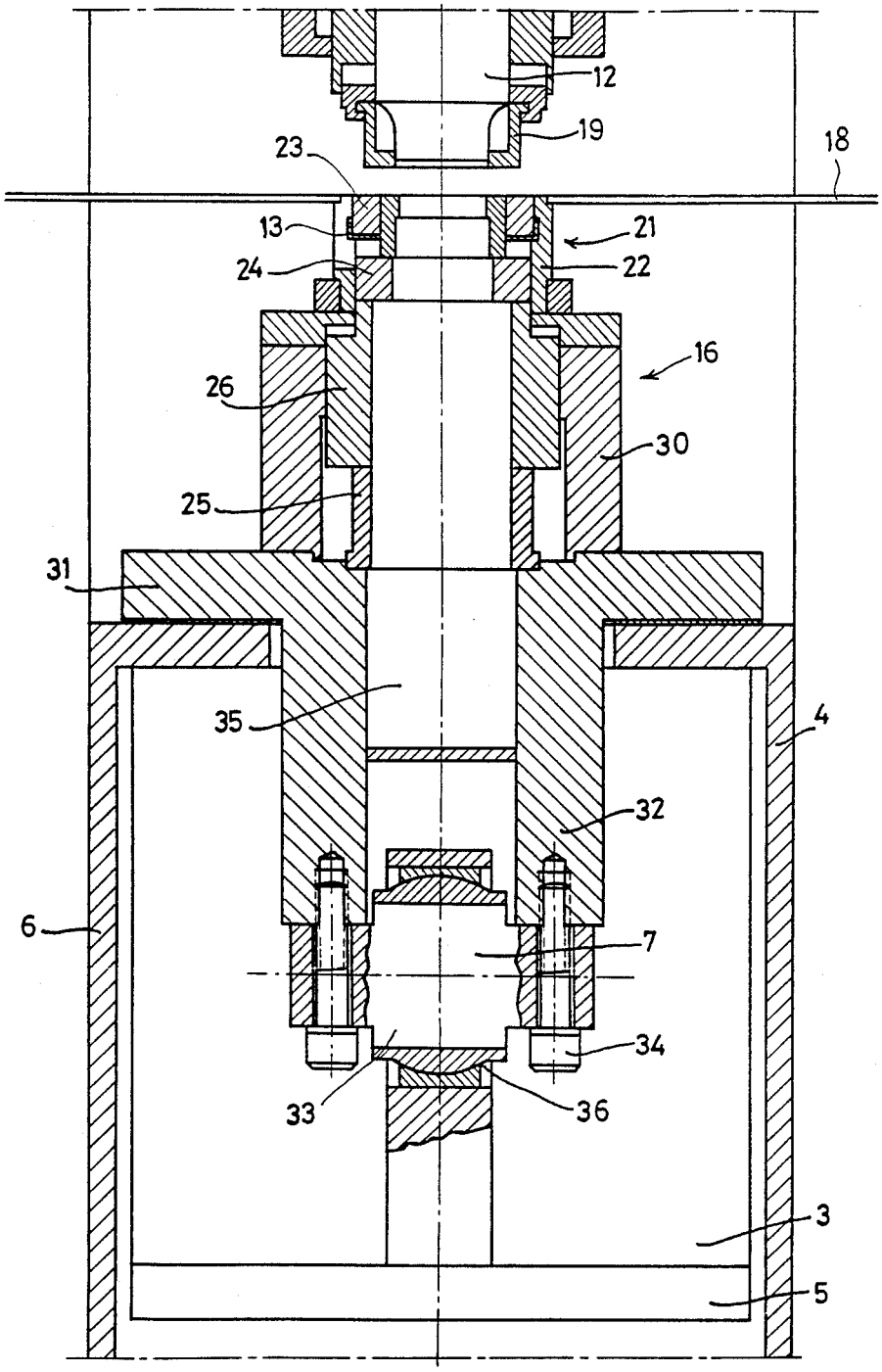
FIG. 4 shows a detail of FIG. 3, on an enlarged scale.

An assembly 16 of parts if provided and transmits the punch forces exerted on the die 13 to the hinge joint 7. The assembly 16 of parts is explained with reference to FIG. 4.

The die 13 is placed in a die holder 21, comprising a centering ring 22, a gauge ring 23, and a supporting ring 24, the gauge ring and supporting ring being selected depending on the size of the die 13.

The die 13 rests via the supporting ring 24 on a top wedge 26, which in turn rests on a counterwedge 25. The angles of inclination of these wedges complement each other, so that the bottom and top bearing faces can be absolutely parallel. The height of the supporting ring 24, and thus of the die 13 resting thereon, can be set by moving the counterwedge 25 in the horizontal direction.

A piston 27 in a hydraulic cylinder 28 presses the counterwedge 25 against the spring force of a return spring (not shown), in such a way that the wedge 26 is forced upwards through the centering ring 22 and against the supporting ring 24. The supporting ring 24 goes upwards until the counterwedge 25 presses against a threaded spindle. The die can be set to the correct height by screwing or unscrewing the threaded spindle by means of a knob 29 (for the hydraulic oil there is an accumulator, which is not shown).

It can be seen from the above that the wedge 26 also centers the die holder 21. The wedge 26 and the counterwedge 25 are in a centering tube 30. The wedge 26 can move only upwards along the axis of the tools 12, 13 and downwards, and the counterwedge 25 only at right angles to said axis.

The punching force hitting the die is transmitted directly to the bottom arm 5 of the first frame part 3 via the supporting ring 24, the wedge 26, the counterwedge 25, a positioning plate 31, fillers 32, a ball joint bearing and a shaft 33 (connected by bolts 34 to fillers 32). All this is connected only via a positioning plate 31 by means of adjustment bolts (not shown) to the second frame part 4. The function of the positioning plate 31 is therefore to position the above parts in the common axis of the tools 12, 13 placed between the arms 5, 6, 8, 11 of the C-shaped frame parts 3 and 4. The positioning plate also transmits the weight of the first frame part 3, the hinge joints 9 and 7, the connecting element 10, the supporting blocks 34, the positioning plate 31, the wedge 26, the counterwedge 25, the centering tube 30, the supporting ring 24, the centering ring 22, the die 13 and the die holder 21 to the second frame part 4.

It is clear from the above description that the punching forces exerted by the punch 12 are transmitted directly by the assembly 16 of parts to the bottom hinge joint 7, and not directly to any part of the second frame part 4.

A space is recessed inside all parts forming part of the assembly 16 of parts (the die holder 21, the wedge 26 with counterwedge 25, the positioning plate 31, the fillers 32). This means that the slug can fall downwards. A sloping plate 35 is used to guide the slugs out of the machine, for example, to a waste bin (not shown).

The hinge joint 7 comprises a pin 33 which is essentially at right angles to the principal plane of the first C-shaped frame part 3. The pin 33 is rotatably mounted in the bottom arm 5 of the first frame part 3 by means of a ball joint bearing 36. The top hinge 9 is of a corresponding design.

Figure 5:
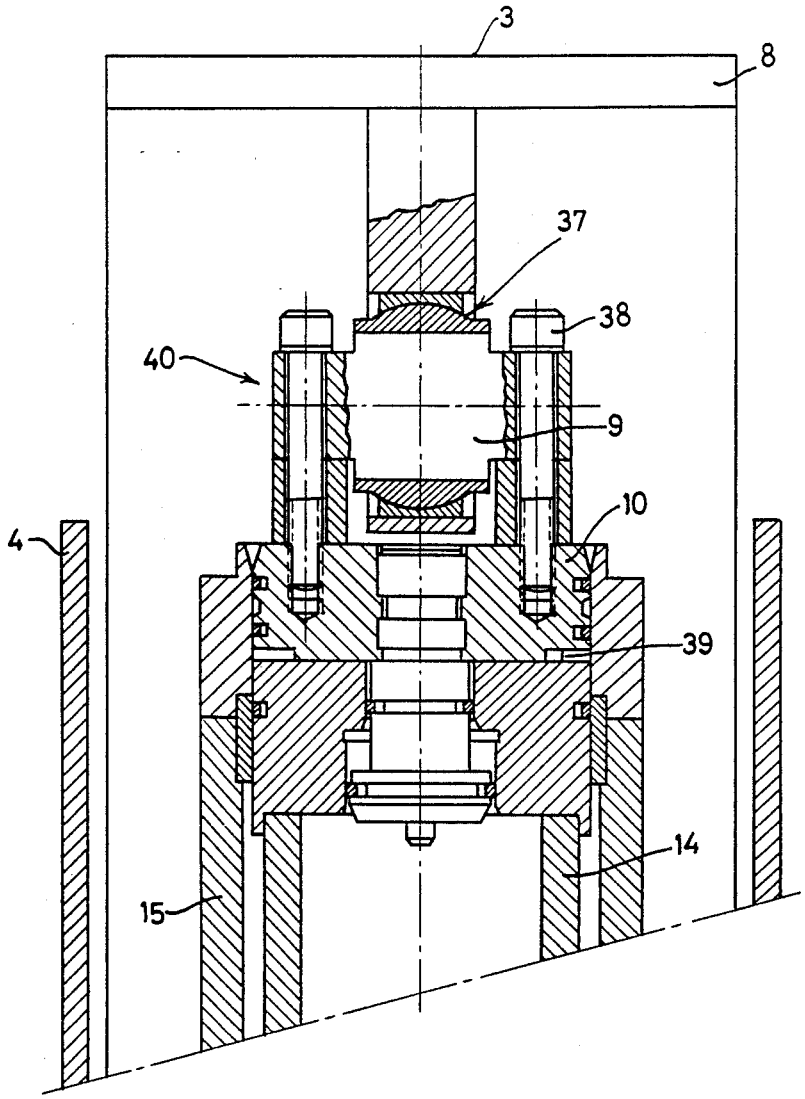
FIG. 5 shows another detail of FIG. 3, on an enlarged scale.

The connection of the hydraulic cylinder 15 to the top arm of the first C-shaped frame part 3 will now be described with reference to FIG. 5.

The hinge pin 9 is mounted in the top arm 8 of the first frame part 3 by means of a ball joint bearing 37. Ball joint bearings are preferably used as the bearings of the two hinge pins 7 and 9, because they permit a slight angular movement, so that the two hinge pins 7, 9 can be set absolutely at right angles to the principal place of the first frame part 3. The hinge pin 9 is fixed to a cover 10 of the hydraulic cylinder 15 by means of bolts 38. This cover 10 can be moved in the axial direction of the cylinder coinciding with the working direction of the tools relative to the part of the cylinder 15 connected to the second C-shaped frame part 4. It is possible in this way, if hydraulic fluid is introduced into the space 39 between the piston 14 and the cover 10 and the punch 12 is moved against the workpiece, for the top arm 8 of the first frame part 3 to be moved upwards through the influence of the reaction force and to gape. The cylinder 15, and thus the second frame part 4, is not loaded by any force which tends to move them out of their idle positions.

What is claimed is:

1. A machine tool, in particular a machine for working with punches and dies on parts formed from sheet material, comprising an essentially C-shaped frame made up of two parallel-connected, essentially C-shaped frame parts, each having a top arm and a bottom arm, said arms each having an end, tools positioned between said arms the first frame part being designed to absorb the reaction forces from forces exerted by said tools to define a working direction of the tools, and the second frame part being designed to hold the tools in a desired position relative to each other, the two C-shaped frame parts near ends of the arms thereof being connected to each other only by means of a hinge joint between the bottom arm of the first C-shaped frame part and the neighboring bottom arm of the second C-shaped frame part, and a connecting element having one side hingedly connected to the top arm of the first C-shaped frame part by means of a hinge joint and having an other side connected to the top arm of the second C-shaped frame part, in such a way that said connecting element can be moved in the working direction of the tools, and the axes of the hinge joints being essentially at right angles to the principal plane of the C-shaped frame part, and intersect a common axis of tools placed between the arms of the C-shaped frame parts.

2. The machine tool of claim 1, which is provided with a hydraulic piston/cylinder combination for driving one of said tools which is movable relative to the frame, and wherein the hydraulic cylinder is fixed on the top arm of the second C-shaped frame part which has to hold the tools in the desired position relative to each other, and the hydraulic cylinder has a cover on the top side, which cover can be moved in the axial direction of the cylinder coinciding with the working direction of the tools relative to the cylinder connected to the second C-shaped frame part, and is connected to the top arm of the first C-shaped frame part by means of a hinge joint.

3. The machine tool of claim 1, wherein the hinge joints each consist of a pin which is essentially at right angles to the principal plane of the first C-shaped frame part.

4. A frame for a machine tool, in particular a machine for working with punches and dies on parts formed from sheet material, said frame being made up of two parallel-connected, essentially C-shaped frame parts, each having a top arm and a bottom arm said arms each having an end, tools positioned between said arms the first frame part being designed to absorb the reaction forces from forces exerted by said tools to define a working direction of the tools, and the second frame part being designed to hold the tools in a desired position relative to each other, the two C-shaped frame parts near ends of the arms thereof being connected to each other only by means of a hinge joint between the bottom arm of the first C-shaped frame part and the neighboring bottom arm of the second C-shaped frame part, and a connecting element having one side hingedly connected to the top arm of the first C-shaped frame part by means of a hinge joint and having an other side connected to the top arm of the second C-shaped frame part, in such a way that said connecting element can be moved in the working direction of the tools, and the axes of the hinge joints being essentially at right angles to the principal plane of the C-shaped frame part, and intersect a common axis of tools placed between the arms of the C-shaped frame parts.

5. The machine tool of claim 3 wherein each said pin is rotatably mounted in at least one of the C-shaped frame parts by means of a ball joint bearing.

* * * * *